US010640734B2

(12) United States Patent
Scheibel et al.

(10) Patent No.: US 10,640,734 B2
(45) **Date of Patent: *May 5, 2020**

(54) SURFACTANT AND DETERGENT COMPOSITIONS CONTAINING ETHOXYLATED GLYCERINE

(71) Applicant: The Procter & Gamble Company, Cincinnati, OH (US)

(72) Inventors: Jeffrey John Scheibel, Glendale, OH (US); Scott Leroy Cron, Liberty Township, OH (US); Praveen Kumar Depa, Hyde Park, OH (US); Philip James Ganz, Norwood, OH (US); Daniele Lynn Hibbard, Glendale, OH (US); Dennis Allen Beckholt, Fairfield, OH (US); Rajan Keshav Panandiker, West Chester, OH (US); Patrick Christopher Stenger, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/056,603

(22) Filed: Aug. 7, 2018

(65) Prior Publication Data

US 2018/0340137 A1 Nov. 29, 2018

Related U.S. Application Data

(63) Continuation of application No. 15/159,835, filed on May 20, 2016, now Pat. No. 10,059,909.

(60) Provisional application No. 62/165,313, filed on May 22, 2015.

(51) Int. Cl.

| | |
|---|---|
| ***C11D 1/00*** | (2006.01) |
| ***C11D 3/20*** | (2006.01) |
| ***C11D 1/29*** | (2006.01) |
| ***C11D 3/43*** | (2006.01) |
| ***C11D 17/04*** | (2006.01) |
| ***C11D 1/14*** | (2006.01) |
| ***C11D 1/22*** | (2006.01) |
| ***C11D 3/386*** | (2006.01) |
| ***C11D 17/00*** | (2006.01) |

(52) U.S. Cl.

CPC ..... *C11D 3/2068* (2013.01); *C11D 1/146* (2013.01); *C11D 1/22* (2013.01); *C11D 1/29* (2013.01); *C11D 3/38618* (2013.01); *C11D 3/38627* (2013.01); *C11D 3/43* (2013.01); *C11D 17/0004* (2013.01); *C11D 17/043* (2013.01); *C11D 17/045* (2013.01)

(58) Field of Classification Search

None

See application file for complete search history.

(56) References Cited

U.S. PATENT DOCUMENTS

| | | | | |
|---|---|---|---|---|
| 3,794,601 | A | 2/1974 | Kennedy | |
| 5,549,840 | A | 8/1996 | Mondin et al. | |
| 5,998,355 | A | 12/1999 | Brumbaugh | |
| 6,462,008 | B1 | 10/2002 | Ortiz et al. | |
| 6,479,442 | B1 | 11/2002 | Berube et al. | |
| 6,506,717 | B1 | 1/2003 | Kott et al. | |
| 7,202,202 | B2 | 4/2007 | Haeggberg et al. | |
| 7,854,770 | B2 | 12/2010 | Du et al. | |
| 9,550,965 | B2 | 1/2017 | Hulskotter et al. | |
| 2013/0316939 | A1* | 11/2013 | Moragas Arjant ..... | C11D 1/83 510/237 |
| 2016/0130530 | A1 | 5/2016 | Pey Gutierrez et al. | |
| 2016/0340611 | A1 | 11/2016 | Scheibel et al. | |
| 2016/0340619 | A1 | 11/2016 | Scheibel et al. | |
| 2016/0340625 | A1 | 11/2016 | Scheibel et al. | |

FOREIGN PATENT DOCUMENTS

| | | | | |
|---|---|---|---|---|
| DE | 10 2004 027323 | A1 | 12/2005 | |
| EP | 1 661 976 | A1 | 5/2006 | |
| JP | S56118498 | | 9/1981 | |
| JP | 2008156250 | A | 7/2008 | |
| WO | WO19997118284 | * | 5/1997 | |
| WO | WO 2000/29530 | | 5/2000 | |
| WO | WO 2011/074522 | A1 | 6/2011 | |
| WO | WO 2011/0745220 | A1 | 6/2011 | |
| WO | WO-2011074522 | A1 * | 6/2011 | ..... C11D 1/83 |

OTHER PUBLICATIONS

PCT Search Report for International application No. PCT/US2016/031979, dated Jul. 20, 2016, 15 pages.

PCT Search Report for International application No. PCT/US2016/033411, dated May 20, 2016, 11 pages.

PCT Search Report for International application No. PCT/US2016/033412, dated May 20, 2016, 11 pages.

* cited by examiner

*Primary Examiner* — Necholus Ogden, Jr.

(74) *Attorney, Agent, or Firm* — Andres E. Velarde; Gregory S. Darley-Emerson; Lauren Christine Gonzalez

(57) ABSTRACT

The present invention relates generally to methods of making surfactant compositions and detergent compositions.

14 Claims, No Drawings

SURFACTANT AND DETERGENT COMPOSITIONS CONTAINING ETHOXYLATED GLYCERINE

TECHNICAL FIELD

The present invention relates generally to methods of making surfactant compositions and detergent compositions.

BACKGROUND

Fluid detergent products, such as liquids, gels, pastes and the like, are preferred by many consumers over solid detergents. Fluid detergent products may contain surfactants, e.g., anionic surfactants, and one or more solvents, in addition to water. Solvents may provide a variety of benefits: solvents may allow for the formulation of anionic surfactant-rich surfactant systems, particularly for compacted fluid detergents; solvents may adjust the viscosity of a formulation; solvents may allow for the formulation of an isotropic and physically stable formulation; and solvents may allow for the formulation of enzymes, polymers, bleach, chelants, and other ingredients that improve cleaning. Solvents may also be used to formulate stable, shippable, anionic surfactant concentrates, which may be combined downstream with other detergent ingredients to form a final detergent product. Also, some fluid detergent forms, such as fluid unit dose articles, may contain high levels of anionic surfactant and high levels of solvent, such as 30% or more solvent by weight of the total formulation.

Known solvents for use in fluid detergent formulations include 1,2-propane diol (p-diol) (also called propylene glycol), ethanol, diethylene glycol (DEG), 2-methyl-1,3-propanediol (MPD), dipropylene glycol (DPG), oligamines (e.g., diethylenetriamine (DETA), tetraethylenepentamine (TEPA), and glycerine (which may, for example, be used in fluid unit dose articles). However, these known solvents all have significant disadvantages, particularly if used at increased levels, including cost, formulatability, color, dissolution rate, solubility/stability of film in certain fluid unit dose articles, and potential adverse effects on cleaning and/or whiteness.

For example, propylene glycol is known to degrade slowly in the presence of oxygen and therefore may require special storage. Metal contamination, acidic or basic contaminants and higher temperatures all accelerate the degradation reactions. Typical oxidation products are aldehydes, ketones, acids and dioxolanes. A strong odor, higher acidity, higher ultra-violet (UV)-absorption, or high color are indicators that a propylene glycol has started to degrade.

Thus, there remains an ongoing need to identify new solvents that may allow for the formulation of increased concentrations of anionic surfactants in fluid detergent compositions, particularly compact fluid detergent compositions and concentrated surfactant pastes, and may address one or more of the disadvantages of known solvents discussed above.

Separately, the use of alkoxylated glycerine in detergent compositions is known. For example, a detergent composition comprising an ethoxylated glycerine compound represented by the following formula (A) and a fatty acid alkaline metal salt, represented by the formula B, (A)

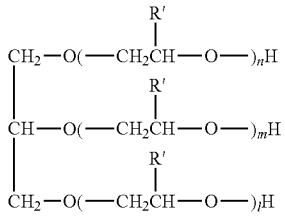

(B)

where R' represents H or $CH_3$, and each of n, m, and l independently represents an integer from 0 to 20; being m+n+l=2-60, preferably 10-45, and where R represents an alkyl or alkenyl group having $C_{7-21}$, and M represents an alkaline metal, is known in the art. The benefits of this known composition include a saving in the amount of antifoaming agents, as well as better performance in skin irritation, oral toxicity and biodegradation, without a loss in detergency.

Another known liquid detergent composition contains from about 1% to about 90% of a surfactant selected from anionic, nonionic, and amphoteric surfactants and mixtures thereof, and a hydrotrope that is a mixture of an alcohol ethoxylate and a polyethylene glycol ether of glycerin, where the hydrotrope provides increased foam generation. The polyethylene glycol ether of glycerin has the following general formula (B):

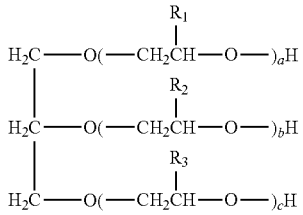

where a+b+c has an average value of from about 2 to about 60, preferably from about 10 to about 45, more preferably from about 20 to about 30, and where $R_1$, $R_2$, and $R_3$ may be the same or different and are selected from the group consisting of H, $CH_3$, or $C_2H_5$.

Aqueous, concentrated dilutable liquid cleaning compositions comprising one or more anionic surfactants, one or more non-ionic surfactants, where the non-ionic surfactant comprises one or more polyethoxylated glycerine ester compounds, and an electrolyte, preferably in combination with one or more amphoteric surfactants, having a total active matter higher than 45 wt % based on the sum of the surfactants, are known. Such compositions are described as exhibiting a controllable viscosity profile that is satisfactory to the consumer while being easy to dilute.

Cleaning compositions containing a modified polyol having alkoxylation and amine capping units are also known.

Finally, cosmetic and personal care products containing glycereth-7, as an anhydrous solvent, are known.

It has been found that alkoxylated glycerine provides a better performing solvent in a fluid detergent product. Furthermore, it has been found that alkoxylated glycerine performs better than many existing solvents used in detergent formulations and surfactant pastes, such as propylene glycol and dipropylene glycol.

SUMMARY

The present disclosure attempts to solve one more of the needs by providing a method of making a concentrated anionic surfactant paste comprising the steps of:

i) mixing from about 30% to about 70% by weight of anionic surfactant, from about 0.5% to about 25% by weight of a solvent comprising an alkoxylated glycerine of formula (I)

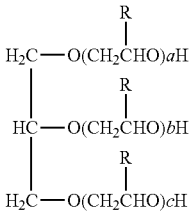

where R is $CH_3$ or H, a+b+c has an average value of from about 1 to about 60, and water to form a concentrated anionic surfactant paste;

ii) storing and optionally shipping said concentrated anionic surfactant paste, wherein said concentrated anionic surfactant paste is stable during storage.

The present disclosure further relates to a method of making a compacted fluid detergent composition comprising the steps of:

i) mixing from about 30% to about 70% by weight of anionic surfactant, from about 0.5% to about 25% by weight of a solvent comprising an alkoxylated glycerine of formula (I)

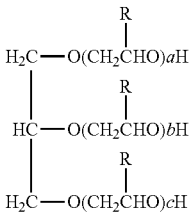

where R is $CH_3$ or H, a+b+c has an average value of from about 1 to about 60, and water to form a concentrated anionic surfactant paste;

ii) storing and optionally shipping said concentrated anionic surfactant paste, wherein said concentrated anionic surfactant paste is stable during storage;

iii) mixing said stable concentrated anionic surfactant paste with adjunct ingredients and water to form a detergent composition.

DETAILED DESCRIPTION

Features and benefits of the present invention will become apparent from the following description, which includes examples intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein in reference to Formula (I), the term "average value of a+b+c" refers to the average moles of ethylene oxide, which is the same as the average degree of ethoxylation. The average value of a+b+c may be an integer or a fraction.

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein the phrase "detergent composition" or "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

It should be understood that the terms glycerine, glycerol, and glycerin are synonyms and refer to the following molecule:

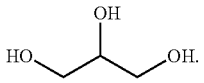

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the detergent composition unless otherwise specified.

Method of Making Surfactant Compositions and Detergent Composition

The present disclosure provides a method of making a concentrated anionic surfactant paste comprising the steps of:

i) mixing from about 30% to about 70% by weight of anionic surfactant, from about 0.5% to about 25% by weight of a solvent comprising an alkoxylated glycerine of formula (I)

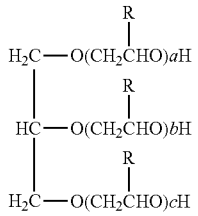

where R is $CH_3$ or H, a+b+c has an average value of from about 1 to about 60, and water to form a concentrated anionic surfactant paste;

ii) storing and optionally shipping said concentrated anionic surfactant paste, wherein said concentrated anionic surfactant paste is stable during storage.

The present disclosure further relates to a method of making a compacted fluid detergent composition comprising the steps of:

i) mixing from about 30% to about 70% by weight of anionic surfactant, from about 0.5% to about 25% by weight of a solvent comprising an alkoxylated glycerine of formula (I)

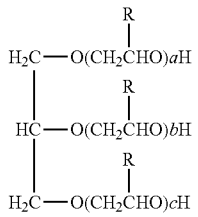

where R is $CH_3$ or H, a+b+c has an average value of from about 1 to about 60, and water to form a concentrated anionic surfactant paste;

ii) storing and optionally shipping said concentrated anionic surfactant paste, wherein said concentrated anionic surfactant paste is stable during storage;

iii) mixing said stable concentrated anionic surfactant paste with adjunct ingredients and water to form a detergent composition.

The concentrated anionic surfactant pastes and the compacted fluid detergent compositions disclosed herein are anionic-surfactant rich.

Anionic Surfactant-Rich Composition

The compositions disclosed herein are highly concentrated in anionic surfactant (anionic-surfactant rich). The compositions may be premixes (also referred to as surfactant concentrates or pastes) of an anionic surfactant and solvent, which can be used to form finished compositions that are suitable for sale to consumers. The compositions may be compact fluid detergents that are suitable for sale to consumers. The compositions of the present disclosure may comprise at least about 10%, or at least about 20%, or at least about 30%, or at least about 50%, or at least about 60%, or at least about 70% anionic surfactant by weight of the composition. The composition of the present disclosure may comprise less than 100%, or less than 90%, or less than about 85%, or less than about 70% of an anionic surfactant by weight of the composition. The composition of the present disclosure may comprise from about 10% to about 50%, or about 20% to about 70%, or about 30% to about 70%, or about 30% to about 65%, or about 35% to about 65%, or about 40% to about 60%, anionic surfactant by weight of the composition.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

Non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates. Suitable anionic surfactants may be derived from renewable resources, waste, petroleum, or mixtures thereof. Suitable anionic surfactants may be linear, partially branched, branched, or mixtures thereof.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 12 to 15 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^- M^+$, wherein R is typically a linear $C_8$-$C_{20}$ hydrocarbyl group, which may be straight chain or branched chain, and M is a water-solubilizing cation. In some examples, R is a $C_{10}$-$C_{18}$ alkyl, and M is an alkali metal. In other examples, R is a $C_{12}/C_{14}$ alkyl and M is sodium, such as those derived from natural alcohols.

Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. In one aspect a magnesium salt of LAS is used.

Another example of a suitable alkyl benzene sulfonate is a modified LAS (MLAS), which is a positional isomer that contains a branch, e.g., a methyl branch, where the aromatic ring is attached to the 2 or 3 position of the alkyl chain.

The anionic surfactant may include a 2-alkyl branched primary alkyl sulfates have 100% branching at the C2 position (C1 is the carbon atom covalently attached to the alkoxylated sulfate moiety). 2-alkyl branched alkyl sulfates and 2-alkyl branched alkyl alkoxy sulfates are generally derived from 2-alkyl branched alcohols (as hydrophobes). 2-alkyl branched alcohols, e.g., 2-alkyl-1-alkanols or 2-alkyl primary alcohols, which are derived from the oxo process, are commercially available from Sasol, e.g., LIAL®, ISALCHEM® (which is prepared from LIAL® alcohols by a fractionation process). C14/C15 branched primary alkyl sulfate are also commercially available, e.g., namely LIAL® 145 sulfate.

The anionic surfactant may include a mid-chain branched anionic surfactant, e.g., a mid-chain branched anionic detersive surfactant, such as, a mid-chain branched alkyl sulphate and/or a mid-chain branched alkyl benzene sulphonate.

Additional suitable anionic surfactants include methyl ester sulfonates, paraffin sulfonates, α-olefin sulfonates, and internal olefin sulfonates.

The composition of the present disclosure may comprise an anionic surfactant selected from the group consisting of linear or branched alkyl benzene sulfonates, linear or branched alkoxylated alkyl sulfates, linear or branched alkyl sulfates, and mixtures thereof. The composition of the present disclosure may comprise from about 30% to about 70% by weight of linear or branched alkoxylated alkyl sulfate. The composition of the present disclosure may comprise from about 30% to about 60% by weight of linear or branched alkyl sulfates, linear or branched alkyl benzene sulfonates, or mixtures thereof. The composition of the present disclosure may comprise from about 30% to about 60% by weight of 2-alkyl branched primary alkyl sulfates.

Solvent

It has been found that using a solvent that comprises an alkoxylated glycerine to make a concentrated anionic surfactant paste improves the stability and color of the paste (and the final detergent product thereof). In addition, the alkoxylated glycerine solvent disclosed herein is more efficient than known solvents.

The solvent described herein comprises an alkoxylated glycerine. The alkoxylated glycerin may optionally have a selected average degree of alkoxylation and, optionally, a selected alkoxylation distribution.

The paste and detergent compositions disclosed herein may comprise at least about 0.5%, or at least about 1%, or at least about 2%, or at least about 3% by weight of the composition of a solvent comprising an alkoxylated glycerine. The composition of the present disclosure may comprise less than 25%, or less than 20%, or less than about 15%, or less than about 10%, or less than about 6% by weight of the composition of a solvent comprising an alkoxylated glycerine.

The alkoxylated glycerine disclosed herein has the following general Formula (I):

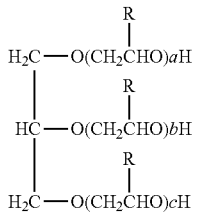

where R is $CH_3$ or H, a+b+c has an average value of from about 1 to about 60. The R groups may be identical.

The alkoxylated glycerine described herein is generally not a single compound as suggested by formula (I), but rather, a mixture of several homologs having varied numbers of total (a+b+c) alkylene oxide (AO) units per mole of glycerine. And, the AO units may be bound to the glycerine molecule in any number of ways across the three branches of the molecule (see Table 1, Formulas V and VI). For example, an alkoxylated glycerine molecule having a+b+c=3 (a total of three AOs) has several isomers—all three AOs may be on a single branch (a, b, or c), each of the three AOs may be on a different branch, or two of the three AOs may be on one branch and the third AO may be on a different branch.

Formulas IV-XX are examples of alkoxylated glycerine homologs that may be present in an alkoxylated glycerine composition having an average of 1.0 moles of ethylene oxide per mole of glycerine (IV-XII) or 1.0 moles of propylene oxide per mole of glycerine (IV, XIII-XX). The molecules below are illustrative and not all possible isomers are shown, e.g., not all isomers having five EO units are shown.

TABLE 1

IV

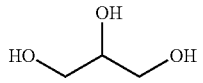

V

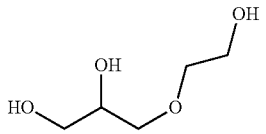

TABLE 1-continued

VI

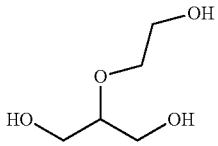

VII

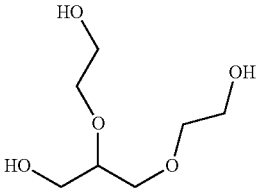

VIII

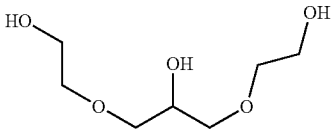

IX

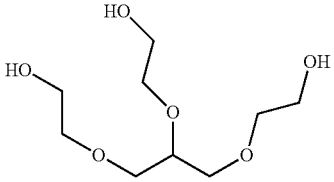

X

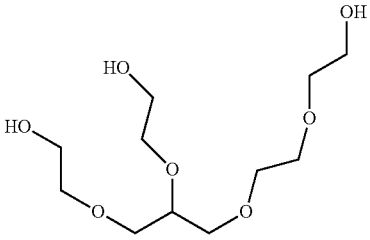

XI

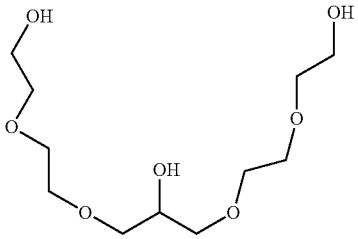

XII

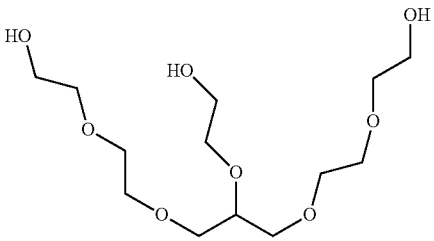

XIII

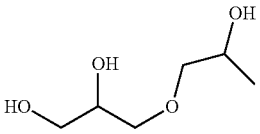

TABLE 1-continued

XIV

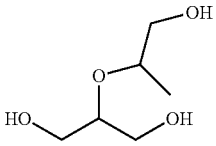

XV

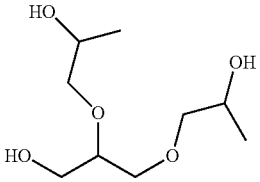

XVI

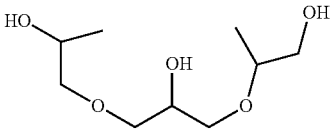

XVII

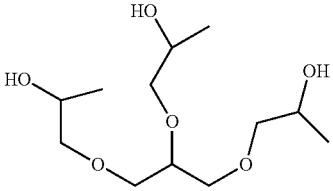

XVIII

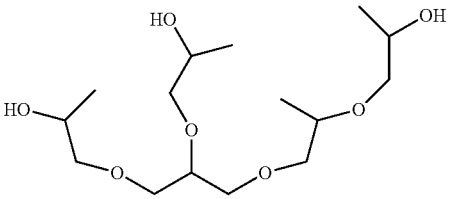

XIX

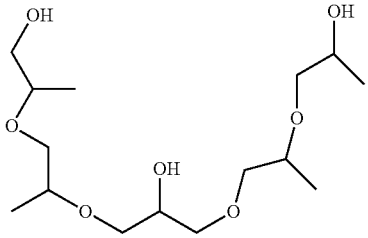

XX

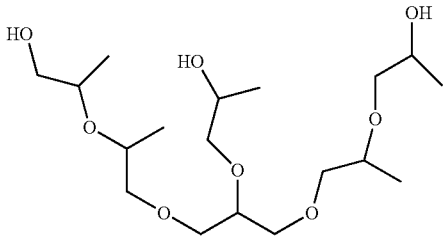

Thus, alkoxylated glycerine is a mixture of several homologs, the distribution of which can be measured by gas chromatography (GC) and mass spectral analysis (MS). Table 2 shows the distribution for an ethoxylated glycerine with an average of 1.0 ethoxylates per mole of glycerine. Table 2 shows six ethoxylated glycerine homologs (e.g., a measurable amount of a homolog containing five EO units (0.44% by weight) is shown). Table 3 shows the distribution for a propoxylated glycerine with an average of 1.0 propoxylates per mole of glycerine. Table 3 shows three propoxylated glycerine homologs.

TABLE 2

| Distribution of Ethoxylated Glycerine with an Average Degree of Ethoxylation of 1.0 | | | | | | | |
|---|---|---|---|---|---|---|---|
| | Compounds with EOx | | | | | | |
| | 0 | 1 | 2 | 3 | 4 | 5 | 6 |
| Measured amount % | 33.03 | 35.19 | 21.11 | 8.08 | 2.16 | 0.44 | Below Detection |

TABLE 3

| Distribution of Propoxylated Glycerine with an Average Degree of Propoxylation of 1.0 | | | | | |
|---|---|---|---|---|---|
| | Compounds with POx | | | | |
| | 0 | 1 | 2 | 3 | 4 |
| Measured amount % | 23.88 | 44.41 | 25.33 | 5.72 | Below Detection |

As shown in Table 2, significant amounts of glycerine (Gly EO0), glycerine having one ethoxylate unit (Gly EO1), and glycerine having two ethoxylate units (Gly EO2) are present in an ethoxylated glycerine having an average degree of ethoxylation of 1. Without being bound by theory, it is believed that these homologs, Gly EO0, Gly EO1, Gly EO2, may limit the solvency of the ethoxylated glycerine. It is believed that by limiting the concentration of Gly EO0, Gly EO1, Gly EO2, the glycerine ethoxylates of the present disclosure provide improved stabilization of surfactant paste, surfactant concentrates, and concentrated detergent formulations. It is also believed that a fairly narrow or peaked range of ethoxylation may provide an enhanced benefit.

As shown in Table 3, significant amounts of glycerine (Gly PO0) and glycerine having one propoxylate unit (Gly PO1) are present in a propoxylated glycerine having an average degree of propoxylation of 1. Without being bound by theory, it is believed that these homologs, Gly PO0 and Gly PO1, may limit the solvency of the propoxylated glycerine. It is believed that by limiting the concentration of Gly PO0 and Gly PO1, the glycerine propoxylates of the present disclosure provide improved stabilization of surfactant paste, surfactant concentrates, and concentrated detergent formulations. It is also believed that a fairly narrow or peaked range of propoxylation may provide an enhanced benefit.

A "narrow" or "peaked" range alkoxylated glycerine refers to an alkoxylated glycerine having a narrow distribution of homologs. The alkoxylated glycerine of the disclosure may be a narrow range alkoxylated glycerine.

Also, it is possible to blend glycerine or Gly EO1 with an ethoxylated glycerine of the disclosure, particularly a narrow range ethoxylated glycerine of the disclosure. The blending of glycerine or Gly EO1 into a detergent composition or a concentrated surfactant paste, which contains the narrow range ethoxylated glycerine of the disclosure, is identifiable by gas chromatography (GC) and mass spectral analysis (MS). It is believed to be undesirable to blend significant amounts (e.g., 20% by weight of the ethoxylated glycerine) of glycerine or Gly EO1 with the ethoxylated glycerine of the disclosure. Table 4 shows an example of such a distribution.

TABLE 4*

| Distribution of a Blend of Ethoxylated Glycerine with an Average Degree of Ethoxylation of 7.0 and 20% (by weight of the ethoxylated glycerine) Glycerine | | | | | | | | | | | | |
|---|---|---|---|---|---|---|---|---|---|---|---|---|
| | GO | G1 | G2 | G3 | G4 | G5 | G6 | G7 | G8 | G9 | G10 | G11 |
| Gly 7.0 | ND | ND | ND | 1.91 | 6.02 | 11.90 | 16.53 | 17.98 | 16.23 | 12.49 | 8.31 | 4.78 |
| Gly 7.0 with 20% Glycerine | 20.00 | ND | ND | 1.53 | 4.82 | 9.52 | 13.22 | 14.38 | 12.98 | 9.99 | 6.65 | 3.82 |

*Minor impurities are not included but make up the balance of the blend (add up to 100%).

It is also possible to blend glycerine or Gly PO1 with a propoxylated glycerine of the disclosure, particularly a narrow range propoxylated glycerine of the disclosure. The blending of glycerine or Gly PO1 into a detergent composition or a concentrated surfactant paste, which contains the narrow range propoxylated glycerine of the disclosure, is identifiable by gas chromatography (GC) and mass spectral analysis (MS). It is believed to be undesirable to blend significant amounts (e.g., 20% by weight of the propoxylated glycerine) of glycerine or Gly PO1 with the propoxylated glycerine of the disclosure. Table 5 shows an example of such a distribution.

TABLE 5*

| Distribution of a Blend of Propoxylated Glycerine with an Average Degree of Propoxylation of 3.0 and 20% (by weight of the propoxylated glycerine) Glycerine | | | | | | | | |
|---|---|---|---|---|---|---|---|---|
| | GO | G1 | G2 | G3 | G4 | G5 | G6 | G7 |
| Gly 3.0 | 0.083 | 2.00 | 18.80 | 46.36 | 25.22 | 6.29 | 0.97 | ND |
| Gly 3.0 with 20% Glycerin | 20.083 | 1.60110 | 15.04320 | 37.08800 | 20.17600 | 5.03200 | 0.77600 | ND |

*Minor impurities are not included but make up the balance of the blend (add up to 100%).

Also, it is known that in the chemical production process for preparing glycerine alkoxylates via standard base catalysis, the glycerine starting material may not be 100% free of water. Water may also come in with the base, which is typically a concentrate in water and is stripped prior to adding the alkylene oxide. Drying the glycerine/base may be expensive and may take substantial processing time in the reactor. Therefore, it is common practice to dry to a certain level of water (which varies from plant to plant) and proceed with adding alkylene oxide, thereby producing some polyalkylene glycol (e.g., polyethylene glycol, polypropylene glycol), as an impurity. The amount of polyalkylene glycol will vary, based on the level of water present. The amount of polyalkylene glycol may be in the range of about 1% to about 5%, or less than about 1%.

The alkoxylated glycerine disclosed herein may have the following Formula (II):

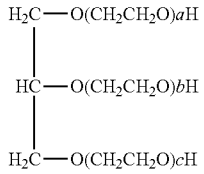

where a+b+c has an average value of from about 1 to about 24, or from about 2 to about 20, or from about 5 to about 10.

The alkoxylated glycerine disclosed herein may have the following Formula (III):

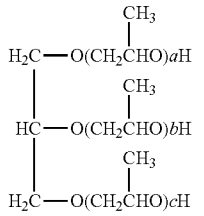

where a+b+c has an average value of from about 1 to about 10, or from about 2 to about 8, or from about 2 to about 6.

If the alkoxylated glycerine is ethoxylated (Formula II), the ethoxylated glycerine may have a distribution where less than about 10%, or less than about 1%, by weight of the ethoxylated glycerine are ethoxylated glycerine homologs of formula (I) having a+b+c<2.

If the alkoxylated glycerin is propoxylated (Formula III), the propoxylated glycerine may have a distribution where less than about 70%, less than about 50%, less than about 30%, less than about 20%, less than about 10%, or less than about 5%, by weight of the propoxylated glycerine are propoxylated glycerine homologs of formula (I) having a+b+c<1.

The solvent may further comprise glycerine, ethanol, propylene glycol, diethylene glycol, dipropylene glycol, 1,2-propylene glycol, cellulosic ethanol, renewable propylene glycol, renewable dipropylene glycol, other solvents used in detergent formulation, and mixtures thereof.

The method disclosed herein may be used to make a surfactant paste. A surfactant paste is a premix of an anionic surfactant and solvent (also referred to as a surfactant concentrate or a concentrated surfactant paste), which can be used to form a finished detergent composition that is suitable for sale to consumers. The method disclosed herein may be used to make the finished detergent composition.

The surfactant paste of the disclosure may comprise from about 30% to about 70% by weight of an anionic surfactant, a solvent comprising an alkoxylated glycerine of formula (I)

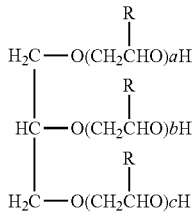

where R is $CH_3$ or H, a+b+c has an average value of from about 1 to about 60, and water. The R groups may be identical. The solvent may further comprise glycerine, ethanol, propylene glycol, diethylene glycol, dipropylene glycol, or mixtures thereof.

The detergent composition of the disclosure may comprise from about 10% to about 50% by weight of an anionic surfactant, a solvent comprising an alkoxylated glycerine of formula (I)

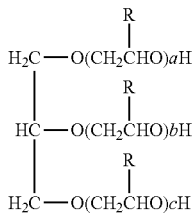

where R is $CH_3$ or H, a+b+c has an average value of from about 1 to about 60, an adjunct, and water. The R groups may be identical. The solvent may further comprise propoxylated glycerine, ethanol, propylene glycol, diethylene glycol, dipropylene glycol, or mixtures thereof. The adjunct may be selected from the group consisting of a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof. The composition may comprise from about 0.001% to about 1% by weight of an enzyme (as an adjunct), which may be selected from the group consisting of lipase, amylase, protease, mannanase, cellulase, pectinase, and mixtures thereof. The composition may be a form selected from the group consisting of a liquid laundry detergent, a gel detergent, a single-phase or multi-phase unit dose detergent, a detergent contained in a single-phase or multi-phase or multi-compartment water soluble pouch, a liquid hand dishwashing composition, a laundry pretreat product, er, a fabric softener composition, and mixtures thereof.

The compositions of the disclosure may be substantially free of alkoxylated glycerine ester.

Water

The compositions may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water. When the composition is in unitized dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

Adjuncts

The compositions disclosed herein, particularly the compacted fluid detergents that are suitable for sale to consumers (final products), may comprise adjunct ingredients.

Surfactants

Suitable adjuncts include surfactants, such as nonionic surfactants, cationic surfactants, zwitterionic surfactants, amphoteric surfactants, and ampholytic surfactants.

Nonionic Surfactants

Suitable nonionic surfactants include alkoxylated fatty alcohols. The nonionic surfactant may be selected from ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkyl alkoxylated alcohol. Suitable nonionic surfactants also include those sold under the tradename Lutensol® from BASF.

Cationic Surfactants

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$.

Amphoteric Surfactants

Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Suitable amphoteric surfactants also include sarcosinates, glycinates, taurinates, and mixtures thereof.

Suitable adjunct ingredients also include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds suppressors, softeners, and perfumes.

Enzymes

The compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the composition.

Enzyme Stabilizing System

The compositions may optionally comprise from about 0.001% to about 10%, or from about 0.005% to about 8%, or from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the detergent composition. In the case of aqueous detergent compositions comprising protease, a reversible protease inhibitor, such as a boron compound, including borate, 4-formyl phenylboronic acid, phenylboronic acid and derivatives thereof, or compounds such as calcium formate, sodium formate and 1,2-propane diol may be added to further improve stability.

Builders

The compositions may comprise a builder. Built compositions typically comprise at least about 1% builder, based on the total weight of the composition. Liquid detergent compositions may comprise up to about 10% builder, and in some examples up to about 8% builder, of the total weight of the composition.

Suitable builders include aluminosilicates (e.g., zeolite builders, such as zeolite A, zeolite P, and zeolite MAP), silicates, phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Alternatively, the composition may be substantially free of builder.

Structurant/Thickeners

Suitable structurants/thickeners include di-benzylidene polyol acetal derivative. The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. The DBPA derivative may comprise a dibenzylidene sorbitol acetal derivative (DBS).

Suitable structurants/thickeners also include bacterial cellulose. The fluid detergent composition may comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like.

Suitable structurants/thickeners also include coated bacterial cellulose. The bacterial cellulose may be at least partially coated with a polymeric thickener. The at least partially coated bacterial cellulose may comprise from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

Suitable structurants/thickeners also include cellulose fibers. The composition may comprise from about 0.01 to about 5% by weight of the composition of a cellulosic fiber. The cellulosic fiber may be extracted from vegetables, fruits or wood. Commercially available examples are Avicel® from FMC, Citri-Fi from Fiberstar or Betafib from Cosun.

Suitable structurants/thickeners also include non-polymeric crystalline hydroxyl-functional materials. The composition may comprise from about 0.01 to about 1% by weight of the composition of a non-polymeric crystalline, hydroxyl functional structurant. The non-polymeric crystalline, hydroxyl functional structurants generally may comprise a crystallizable glyceride which can be pre-emulsified to aid dispersion into the final fluid detergent composition. The crystallizable glycerides may include hydrogenated castor oil or "HCO" or derivatives thereof, provided that it is capable of crystallizing in the liquid detergent composition.

Suitable structurants/thickeners also include polymeric structuring agents. The compositions may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof.

Suitable structurants/thickeners also include di-amido-gellants. The external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. The amido groups may be different or the same. Non-limiting examples of di-amido gellants are: N,N'-(2S,2'S)-1,1'-(dodecane-1,12-diylbis(azanediyl))bis(3-methyl-1-oxobutane-2,1-diyl)diisonicotinamide; dibenzyl (2S,2'S)-1,1'-(propane-1,3-diylbis(azanediyl))bis(3-methyl-1-oxobutane-2,1-diyl)dicarbamate; dibenzyl (2S,2'S)-1,1'-(dodecane-1,12-diylbis(azanediyl))bis(1-oxo-3-phenylpropane-2,1-diyl)dicarbamate.

Polymeric Dispersing Agents

The cleaning composition may comprise one or more polymeric dispersing agents. Examples are carboxymethyl-cellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The cleaning composition may comprise one or more amphiphilic cleaning polymers such as the compound having the following general structure: bis(($C_2H_5O$)($C_2H_4O$)n)($CH_3$)—$N^+$—$C_xH_{2x}$—$N^+$—($CH_3$)-bis(($C_2H_5O$)($C_2H_4O$)n), wherein n=from 20 to 30, and x=from 3 to 8, or sulphated or sulphonated variants thereof.

The cleaning composition may comprise amphiphilic alkoxylated grease cleaning polymers which have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Carboxylate polymer—The detergent composition may also include one or more carboxylate polymers, which may optionally be sulfonated. Suitable carboxylate polymers include a maleate/acrylate random copolymer or a poly (meth)acrylate homopolymer. In one aspect, the carboxylate polymer is a poly(meth)acrylate homopolymer having a molecular weight from 4,000 Da to 9,000 Da, or from 6,000 Da to 9,000 Da.

Alkoxylated polycarboxylates may also be used in the detergent compositions herein to provide grease removal. Such materials are described in WO 91/08281 and PCT 90/01815. Chemically, these materials comprise poly(meth) acrylates having one ethoxy side-chain per every 7-8 (meth) acrylate units. The side-chains are of the formula —$(CH_2CH_2O)_m$ $(CH_2)_nCH_3$ wherein m is 2-3 and n is 6-12. The side-chains are ester-linked to the polyacrylate "backbone" to provide a "comb" polymer type structure. The molecular weight can vary, but may be in the range of about 2000 to about 50,000. The detergent compositions described herein may comprise from about 0.1% to about 10%, and in some examples, from about 0.25% to about 5%, and in other examples, from about 0.3% to about 2%, by weight of the detergent composition, of alkoxylated polycarboxylates.

The compositions may include an amphiphilic graft co-polymer. A suitable amphiphilic graft co-polymer comprises (i) a polyethyelene glycol backbone; and (ii) and at least one pendant moiety selected from polyvinyl acetate, polyvinyl alcohol and mixtures thereof. A suitable amphilic graft co-polymer is Sokalan® HP22, supplied from BASF. Suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Soil Release Polymer

The detergent compositions of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_5$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic Polymer

The cleaning compositions of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Amines

Amines may be used in the compositions described herein for added removal of grease and particulates from soiled materials. The compositions described herein may comprise from about 0.1% to about 10%, in some examples, from about 0.1% to about 4%, and in other examples, from about 0.1% to about 2%, by weight of the detergent composition, of additional amines Non-limiting examples of additional amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents

The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition.

Bleach Catalysts

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners

Optical brighteners or other brightening or whitening agents may be incorporated at levels of from about 0.01% to about 1.2%, by weight of the composition, into the detergent compositions described herein. Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. In some examples, the fluorescent brightener is selected from the group consisting of disodium 4,4'-bis{[4-anilino-6-morpholino-s-triazin-2-yl]-amino}-2,2'-stilbenedisulfonate (brightener 15, commercially available under the tradename Tinopal AMS-GX by Ciba Geigy Corporation), disodium4,4'-bis{[4-anilino-6-(N-2-bis-hydroxyethyl)-s-triazine-2-yl]-amino}-2,2'-stilbenedisulonate (commercially available under the tradename Tinopal UNPA-GX by Ciba-Geigy Corporation), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal 5BM-GX by Ciba-Geigy Corporation). More preferably, the fluorescent brightener is disodium 4,4'-bis{[4-anilino-6-morpholino-s-triazin-2-yl]-amino}-2,2'-stilbenedisulfonate.

The brighteners may be added in particulate form or as a premix with a suitable solvent, for example nonionic surfactant, propanediol.

Fabric Hueing Agents

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes also include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Suitable polymeric dyes also include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. Suitable polymeric dyes also include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

The aforementioned fabric hueing agents can be used in combination (any mixture of fabric hueing agents can be used).

Encapsulates

The compositions may comprise an encapsulate. The encapsulate may comprise a core, a shell having an inner and outer surface, where the shell encapsulates the core.

The encapsulate may comprise a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other co-monomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. When the shell comprises an aminoplast, the aminoplast may comprise polyurea, polyurethane, and/or polyureaurethane. The polyurea may comprise polyoxymethyleneurea and/or melamine formaldehyde.

The encapsulate may comprise a core, and the core may comprise a perfume. The encapsulate may comprise a shell, and the shell may comprise melamine formaldehyde and/or cross linked melamine formaldehyde. The encapsulate may comprise a core comprising a perfume and a shell comprising melamine formaldehyde and/or cross linked melamine formaldehyde Suitable encapsulates may comprise a core material and a shell, where the shell at least partially surrounds the core material. The core of the encapsulate comprises a material selected from a perfume raw material and/or optionally another material, e.g., vegetable oil, esters of vegetable oils, esters, straight or branched chain hydrocarbons, partially hydrogenated terphenyls, dialkyl phthalates, alkyl biphenyls, alkylated naphthalene, petroleum spirits, aromatic solvents, silicone oils, or mixtures thereof.

The wall of the encapsulate may comprise a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

Suitable formaldehyde scavengers may be employed with the encapsulates, for example, in a capsule slurry and/or added to a composition before, during, or after the encapsulates are added to such composition.

Suitable capsules can be purchased from Appleton Papers Inc. of Appleton, Wis. USA.

Perfumes

Perfumes and perfumery ingredients may be used in the detergent compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Dye Transfer Inhibiting Agents

Fabric detergent compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof. Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Suds Suppressors

Compounds for reducing or suppressing the formation of suds can be incorporated into the detergent compositions described herein. Suds suppression can be of particular importance in the so-called "high concentration cleaning process" and in front-loading style washing machines. The detergent compositions herein may comprise from 0.1% to about 10%, by weight of the composition, of suds suppressor.

Examples of suds suppressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols.

Additional suitable antifoams are those derived from phenylpropylmethyl substituted polysiloxanes.

The detergent composition may comprise a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor.

The detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

Suds Boosters

If high sudsing is desired, suds boosters such as the $C_{10}$-$C_{16}$ alkanolamides may be incorporated into the detergent compositions at a concentration ranging from about 1% to about 10% by weight of the detergent composition. Some examples include the $C_{10}$-$C_{14}$ monoethanol and diethanol amides. If desired, water-soluble magnesium and/or calcium salts such as $MgCl_2$, MgSO4, $CaCl_2$, $CaSO_4$, and the like, may be added at levels of about 0.1% to about 2% by weight of the detergent composition, to provide additional suds and to enhance grease removal performance.

Conditioning Agents

The composition of the present invention may include a high melting point fatty compound. The high melting point fatty compound useful herein has a melting point of 25° C.

or higher, and is selected from the group consisting of fatty alcohols, fatty acids, fatty alcohol derivatives, fatty acid derivatives, and mixtures thereof. Such compounds of low melting point are not intended to be included in this section. The high melting point fatty compound is included in the composition at a level of from about 0.1% to about 40%, preferably from about 1% to about 30%, more preferably from about 1.5% to about 16% by weight of the composition, from about 1.5% to about 8%.

The composition of the present invention may include a nonionic polymer as a conditioning agent.

Suitable conditioning agents for use in the composition include those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. The concentration of the silicone conditioning agent typically ranges from about 0.01% to about 10%.

The compositions of the present invention may also comprise from about 0.05% to about 3% of at least one organic conditioning oil as the conditioning agent, either alone or in combination with other conditioning agents, such as the silicones (described herein). Suitable conditioning oils include hydrocarbon oils, polyolefins, and fatty esters.

Fabric Enhancement Polymers

Suitable fabric enhancement polymers are typically cationically charged and/or have a high molecular weight. Suitable concentrations of this component are in the range from 0.01% to 50%, preferably from 0.1% to 15%, more preferably from 0.2% to 5.0%, and most preferably from 0.5% to 3.0% by weight of the composition. The fabric enhancement polymers may be a homopolymer or be formed from two or more types of monomers. The monomer weight of the polymer will generally be between 5,000 and 10,000,000, typically at least 10,000 and preferably in the range 100,000 to 2,000,000. Preferred fabric enhancement polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8. The fabric enhancement polymers may be of natural or synthetic origin.

Pearlescent Agent

The laundry detergent compositions of the invention may comprise a pearlescent agent.

Non-limiting examples of pearlescent agents include: mica; titanium dioxide coated mica; bismuth oxychloride; fish scales; mono and diesters of alkylene glycol. The pearlescent agent may be ethyleneglycoldistearate (EGDS).

Hygiene and Malodour

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Buffer System

The detergent compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Water-Soluble Film

The compositions of the present disclosure may be encapsulated within a water-soluble film, for example, a film comprising polyvinyl alcohol (PVOH).

Other Adjunct Ingredients

A wide variety of other ingredients may be used in the detergent compositions herein, including other active ingredients, carriers, hydrotropes, processing aids, dyes or pigments, solvents for liquid formulations, and solid or other liquid fillers, erythrosine, colloidal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphthalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The compositions of the present invention may also contain pigment materials such as nitroso, monoazo, disazo, carotenoid, triphenyl methane, triaryl methane, xanthene, quinoline, oxazine, azine, anthraquinone, indigoid, thioindigoid, quinacridone, phthalocianine, botanical, and natural colors, including water soluble components such as those having C.I. Names. The detergent compositions of the present invention may also contain antimicrobial agents.

Methods of Use

The present invention includes methods for cleaning soiled material. Compact fluid detergent compositions that are suitable for sale to consumers are suited for use in laundry pretreatment applications, laundry cleaning applications, and home care applications.

Such methods include, but are not limited to, the steps of contacting detergent compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the detergent compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry detergent composition in accord with the invention. An "effective amount" of the detergent composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm in solution. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine). The detergent compositions herein may be used for laundering of fabrics at reduced wash temperatures. These methods of laundering fabric comprise the steps of delivering a laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry detergent composition with water.

Another method includes contacting a nonwoven substrate, which is impregnated with the detergent composition, with a soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Packaging for the Compositions

The compact fluid detergent compositions that are suitable for consumer use can be packaged in any suitable container including those constructed from paper, cardboard, plastic materials, and any suitable laminates. The compact fluid detergent compositions may also be encapsulated in water-soluble film and packaged as a unitized dose detergent composition, for example, mono-compartment pouches or multi-compartment pouches having superposed and/or side-by-side compartments.

EXAMPLES

Example 1: Synthesis of Alkoxylated Glycerine

Reaction:

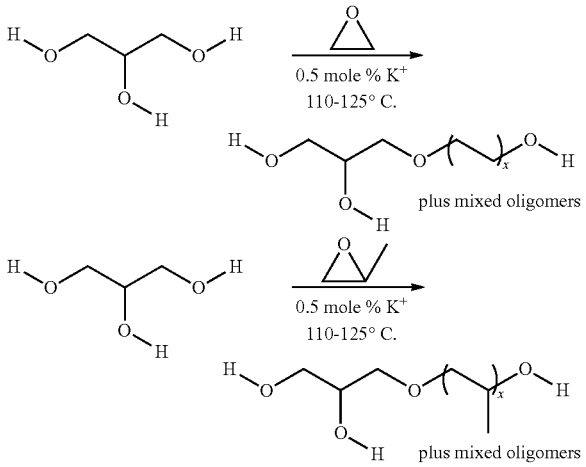

Glycerine is added to a reactor along with a catalyst (0.5 mole % potassium, as a 25% potassium methoxide in methanol solution). The reactor is purged of air using a vacuum and nitrogen cycles. Volatile materials (methanol and water) are removed by sparging with nitrogen and vacuum at 110° C.-115° C. (sparging is done by slowly adding a trickle of nitrogen through the bottom drain valve, while using a water aspirator vacuum). After 1-2 hours, the reactor is filled with nitrogen and vented to 0-5 psig and then heated to between 110° C. and 125° C. Alkylene oxide (EO or PO) is slowly added while stirring at 400 rpm (used throughout) and maintaining the pressure below 200 psig. Each step of the reaction is allowed to run until the pressure decreases, levels off, and is constant for at least 30 minutes.

The addition of alkylene oxide continues until the desired degree of alkoxylation is attained, as measured by increase in weight. Samples having a degree of ethoxylation ranging from 0.25 to 24, as measured by the moles of glycerine to moles of ethylene oxide added, are prepared. Samples having a degree of propoxylation ranging from 0.25 to 12, as measured by the moles of glycerine to moles of propylene oxide added, are prepared.

Prior to collecting samples, residual alkylene oxide is removed by sparging with nitrogen and a vacuum at 110° C. The reactor is then cooled to below 80° C. and the sample is drained from the reactor, while keeping the container purged with nitrogen. After cooling, the sample is neutralized using acetic acid and blanketed with nitrogen.

The reactor used is a Model Number 4572 Parr 1800 ml reactor constructed of T316 stainless steel. It has a magnetic drive stirring assembly that uses an electric motor for agitation. The stir shaft has 2-inch pitched blade impellers. The reactor has a cooling coil and water is used in the cooling coil to keep the temperature from exceeding a programmed set-point. The reactor is monitored and controlled by a Camile data acquisition and control system.

Analysis Method

GC: Equipment HP 6890. Method is a standard method used for analysis of alkoxylated compositions. Verification of the identity of peaks is determined by standard mass spectral analysis methods.

TABLE 6

Analysis of Ethoxylated Glycerine Samples (relative percentages).

| | GO | G1 | G2 | G3 | G4 | G5 | G6 | G7 | G8 | G9 | G10 | G11+ G12+ G13 |
|---|---|---|---|---|---|---|---|---|---|---|---|---|
| Gly | 99.96 | | | | | | | | | | | |
| Gly 1.0 | 33.03 | 35.19 | 21.11 | 8.08 | 2.16 | 0.44 | | | | | | |
| Gly 1.5 | 19.28 | 30.18 | 27.28 | 15.49 | 6.03 | 1.74 | | | | | | |
| Gly 2.0 | 8.49 | 21.52 | 28.38 | 22.75 | 12.14 | 4.75 | 1.48 | 0.39 | | | | |
| Gly 2.5 | 4.98 | 14.36 | 24.19 | 25.22 | 17.53 | 8.75 | 3.42 | 1.11 | 0.30 | | | |
| Gly 3.0 | 1.19 | 7.82 | 18.09 | 25.21 | 22.52 | 13.93 | 6.63 | 2.61 | 0.88 | 0.26 | | |
| Gly 4.0 | 0.75 | 3.46 | 10.30 | 19.08 | 23.17 | 19.52 | 12.56 | 6.61 | 2.95 | 1.13 | 0.35 | |
| Gly 5.0 | 0.16 | 0.90 | 3.98 | 11.02 | 18.90 | 21.51 | 18.13 | 12.30 | 7.01 | 3.44 | 1.45 | 0.65 |
| Gly 6.0 | 0.06 | 0.24 | 1.34 | 5.07 | 11.72 | 17.64 | 19.31 | 16.88 | 12.37 | 7.78 | 4.25 | 3.03 |
| Gly 7.0 | | | | 1.91 | 6.02 | 11.90 | 16.53 | 17.98 | 16.23 | 12.49 | 8.31 | 7.99 |
| Gly 8.0 | | | | 0.64 | 2.72 | 6.91 | 11.86 | 15.68 | 16.97 | 15.49 | 12.15 | 17.31 |

TABLE 7

Analysis of Propoxylated Glycerine Samples (relative percentages).

| | GO | G1 | G2 | G3 | G4 | G5 | G6 | G7 | G8 | G9 | G10 | G11+ G12+ G13+ G14+ |
|---|---|---|---|---|---|---|---|---|---|---|---|---|
| Gly 0.5 | 51.30 | 38.47 | 9.28 | 0.88 | | | | | | | | |
| Gly 1.0 | 23.88 | 44.41 | 25.33 | 5.72 | | | | | | | | |
| Gly 1.5 | 9.16 | 35.10 | 38.00 | 15.38 | 2.37 | | | | | | | |
| Gly 2.0 | 2.91 | 21.43 | 41.10 | 27.53 | 6.16 | 0.69 | | | | | | |
| Gly 2.5 | 0.49 | 8.43 | 33.51 | 41.03 | 14.10 | 2.39 | | | | | | |
| Gly 3.0 | 0.08 | 2.00 | 18.8 | 46.4 | 25.22 | 6.29 | 0.97 | | | | | |
| Gly 4.0 | 0.85 | | 1.05 | 22.2 | 37.3 | 25.1 | 10.04 | 2.81 | 0.58 | | | |
| Gly 6.0 | 0.11 | | | 1.67 | 8.96 | 19.19 | 24.29 | 21.92 | 14.4 | 6.9 | 2.45 | |
| Gly 9.0 | | | | | 0.33 | 1.38 | 3.94 | 9.13 | 16.8 | 22.0 | 20.1 | 25.9 |

Example 2: Surfactant Paste and Detergent Samples

Test samples are prepared by standard methods of mixing in a container and, if necessary, are neutralized to pH above 7 and less than 9 for sufficient stability of sulfated surfactants. Sample size is sufficient for accurate weighing of components. Reference samples are matched to samples containing the solvents disclosed herein and placed in a controlled temperature storage room of either 40° C. or 20° C. for periods ranging from 1 week to 4 weeks with periodic visual assessment of the physical state of the sample.

Analysis

Samples are visually evaluated as either passing or failing. Passing samples are visually clear, homogeneous, with no substantial haze or precipitate, and free flowing, when the container is inverted. Failing samples are substantially hazy, have more than one phase (e.g., two distinct visible layers), contain some visible precipitate, or form a gel (semi-solid single layer) that does not flow upon inversion of the container. For example, samples that are free flowing but have more than one phase are evaluated as failing.

The results below in Examples 2(a)-2(f) are visually evaluated as passing or failing, based on the criteria discussed above.

Example 2(a)—37% Surfactant Active (Sodium 2-Alkylbranched Alcohol Sulfate)

Comparison of ethoxylated glycerine solvents versus propylene glycol (PG) or dipropylene glycol (DPG) solvents, measured as percent reduction over propylene glycol (PG) or dipropylene glycol (DPG), with water added as balance of components.

TABLE 8

| Solvent Ingredient: | % solvent level reduction over PG or DPG |
|---|---|
| Glycerine | 0% |
| Glycerine EO1 | 0% |
| Glycerine EO3 | 20% |
| Glycerine EO5 | 30% |
| Glycerine EO7 | 40% |
| Glycerine EO16 | 40% |
| Glycerine EO24 | 40% |

Comparison of propoxylated glycerine solvents versus propylene glycol (PG) solvent, measured as percent reduction over propylene glycol (PG), with water added as balance of components.

TABLE 9

| Solvent Ingredient: | % solvent level reduction over PG |
|---|---|
| Glycerol PO1 | 0% |
| Glycerol PO2 | 0% |
| Glycerol PO3 | 25% |
| Glycerol PO4 | 0% |
| Glycerol PO6 | 0% |

Example 2(b)—50% Surfactant Active (Sodium 2-Alkylbranched Alcohol Sulfate)

Comparison of ethoxylated glycerine solvents versus propylene glycol (PG) or dipropylene glycol (DPG) solvents, measured as percent reduction over propylene Glycol (PG) or dipropylene Glycol (DPG), with water add as balance of components.

TABLE 10

| Solvent Ingredient: | % solvent level reduction over PG or DPG |
|---|---|
| Glycerine EO7 | 30% |
| Glycerine EO16 | Failing* |
| Glycerine EO24 | Failing* |

*Failing due to poor flowability.

Example 2(c)—53% Surfactant Active (Sodium C25EO1.8S)

Comparison of solvent containing propoxylated glycerine and ethanol versus solvent containing propylene glycol (PG) and ethanol or dipropylene glycol (DPG) and ethanol (ethanol concentrations held constant between the data sets that are compared), measured as percent reduction over propylene Glycol (PG) or dipropylene Glycol (DPG), with water add as balance of components.

TABLE 11

| Solvent Ingredient: | % solvent level reduction over PG or DPG |
|---|---|
| Glycerine PO1 | 0% |
| Glycerine PO3 | 20% |

TABLE 11-continued

| Solvent Ingredient: | % solvent level reduction over PG or DPG |
|---|---|
| Glycerine PO4 | 15% |
| Glycerine PO6 | 0% |

Example 2(d)—53% Surfactant Active (Sodium C45EO2.5S)

Comparison of solvent containing propoxylated glycerine and ethanol versus solvent containing propylene glycol (PG) and ethanol (ethanol concentrations held constant between the data sets that are compared), measured as percent reduction over propylene Glycol (PG), with water add as balance of components.

TABLE 12

| Solvent Ingredient: | % solvent level reduction over PG and/or DPG |
|---|---|
| Glycerol PO1 | 0% |
| Glycerol PO3 | 15% |
| Glycerol PO4 | 15% |
| Glycerol PO6 | 0% |

Example 2(e)—Detergent Compositions Containing Sodium Alkyl Ethoxy Sulfate (AES) and Sodium Linear Alkyl Benzene Sulfonate (LAS)

The total anionic surfactant concentration of the detergent compositions is 10% and the ratio of AES to LAS is 10:1. The detergent composition contains additional solvents—ethanol, glycerine, and diethylene glycol, and adjuncts—hydrotropes, such as sodium cumene sulfonate and sodium xylene sulfonate, and additional surfactants—nonionic surfactant and amine oxide. Comparison of ethoxylated glycerine solvents versus propylene glycol (PG) or dipropylene glycol (DPG) solvents, measured as percent reduction over propylene Glycol (PG) or dipropylene Glycol (DPG), with all other ingredient levels (including additional solvents) remaining the same.

TABLE 13

| Solvent Ingredient: | % solvent level reduction over PG or DPG |
|---|---|
| Glycerine EO3 | 0% |
| Glycerine EO7 | 30% |

Example 2(f)—Detergent Compositions Containing Sodium Alkyl Ethoxy Sulfate (AES) and Sodium Linear Alkyl Benzene Sulfonate (LAS)

The total anionic surfactant concentration of the detergent composition is 30% and the ratio of AES to LAS of 1.5:1. The detergent composition contains additional solvents—ethanol, glycerine, and diethylene glycol, and adjuncts—hydrotropes, such as sodium cumene sulfonate and sodium xylene sulfonate, and additional surfactants—nonionic surfactant and amine oxide. Comparison of ethoxylated glycerine solvents versus propylene glycol (PG) or dipropylene glycol (DPG) solvents, measured as percent reduction over propylene Glycol (PG) or dipropylene Glycol (DPG), with all other ingredient levels (including additional solvents) remaining the same.

TABLE 14

| Solvent Ingredient: | % solvent level reduction over PG or DPG |
|---|---|
| Glycerine EO3 | 0% |
| Glycerine EO7 | 20% |

Example 2(g)—Detergent Compositions Containing Sodium 2-Alkylbranched Alcohol Sulfate, Sodium Alkyl Ethoxy Sulfate (AES), and Sodium Linear Alkyl Benzene Sulfonate (LAS)

The total anionic surfactant concentration of the detergent composition is 20% and the ratio of sodium 2-alkylbranched alcohol sulfate to AES to LAS is 13:2:6. The detergent composition contains additional solvents—ethanol, glycerine, and diethylene glycol, and adjuncts—hydrotropes, such as sodium cumene sulfonate and sodium xylene sulfonate, and additional surfactants—nonionic surfactant and amine oxide. Comparison of ethoxylated glycerine solvents versus propylene glycol (PG) or dipropylene glycol (DPG) solvents, measured as percent reduction over propylene Glycol (PG) or dipropylene Glycol (DPG), with all other ingredient levels (including additional solvents) remaining the same.

TABLE 15

| Solvent Ingredient: | % solvent level reduction over PG or DPG |
|---|---|
| Glycerine EO3 | 0% |
| Glycerine EO7 | 30% |

Example 2(h)—Detergent Compositions Containing Sodium Alkyl Ethoxy Sulfate (AES) and Sodium Linear Alkyl Benzene Sulfonate (LAS)

The total anionic surfactant concentration of the detergent composition is 37% and the ratio of AES to LAS is 1.0:1.5. The detergent composition contains additional solvents—ethanol, glycerine, and diethylene glycol, and adjuncts—hydrotropes, such as sodium cumene sulfonate and sodium xylene sulfonate, and additional surfactants—nonionic surfactant and amine oxide. Comparison of ethoxylated glycerine solvents versus propylene glycol (PG) or dipropylene glycol (DPG) solvents, measured as percent reduction over propylene Glycol (PG) or dipropylene Glycol (DPG), with all other ingredient levels (including additional solvents) remaining the same.

TABLE 16

| Solvent Ingredient: | % solvent level reduction over PG or DPG |
|---|---|
| Glycerine EO3 | 0% |
| Glycerine EO7 | 20% |

Example 2(i)—Detergent Compositions Containing Sodium C25AE1.8S Surfactant and Sodium Linear Alkyl Benzene Sulfonate (Avg. Chain Length 11.8)

The total anionic surfactant concentration of the detergent composition is 10% or 50% and the ratio of AES to LAS is 3:1 or 1:10. The detergent composition contains additional solvents, such as ethanol, glycerine, diethylene glycol, dipropylene glycol, and adjuncts, including hydrotropes, such as sodium cumene sulfonate and sodium xylene sulfonate, and additional surfactants, such as nonionic surfactant and amine oxide. Comparison of propoxylated glycerine solvent versus propylene glycol (PG) solvent, measured as percent reduction over propylene Glycol (PG), with all other ingredient levels (including additional solvents) remaining the same.

TABLE 17

| | % solvent level reduction over PG | | | |
|---|---|---|---|---|
| Solvent Ingredient: | 10% 3:1 | 50% 3:1 | 10% 1:10 | 50% 1:10 |
| Glycerol PO1 | 0% | | | |
| Glycerol PO3 | 20% | | | |
| Glycerol PO4 | 15% | | | |
| Glycerol PO6 | 0% | | | |

Example 3—Color Analysis 14.3 g (±0.100 g) of paste is added to a 150 mL beaker. Then 15 mL of ethanol is added to the beaker. The paste is stirred until all the paste is dissolved in the ethanol. Deionized water is then added in an amount such that a 50-gram solution is formed. The solution is then stirred for no longer than 5 minutes to homogenize the sample. The % T at 420 nm is then measured for each sample. The spectrophotometer is blanked with DI water. The following equipment is used: Mettler XS104 Balance S/N B020035782, Beckman DU530 Life Science UV/Vis Spectrophotometer MV 22334, Mettler PM2000 S/N 1113430888.

The % T at 420 nm of six paste samples is measured. Each sample contains 19.6% total solvent. Sample 1 (control) contains 6.12% by weight of propylene glycol and the balance of the solvent is ethanol and other diols.

TABLE 18

| | |
|---|---|
| Paste sample #1 | NaC25AE1.8S, propylene glycol + other diols |
| Paste sample #2: | NaC25AE1.8S, 25% of diols replaced with glycerine-EO7 |
| Paste sample #3: | NaC25AE1.8S, 50% of diols replaced with glycerine-EO7 |
| Paste sample #4: | NaC25AE1.8S, 75% of diols replaced with glycerine-EO7 |
| Paste sample #5: | NaC25AE1.8S, 100% of diols replaced with glycerine-EO7 |
| Paste sample #6: | NaC25AE1.8S, 100% of propylene glycol replaced with glycerine-EO7 |

The results are shown below.

TABLE 19

| Sample No. | Storage Temp. | Storage Time | Δ Color @ 420 nm |
|---|---|---|---|
| 1 (control) | 50° C. | 22 days | −18.16 |
| 2 | 50° C. | 22 days | −12.48 |
| 3 | 50° C. | 22 days | −13.14 |
| 4 | 50° C. | 22 days | −13.98 |
| 5 | 50° C. | 22 days | −0.04 |
| 6 | 50° C. | 23 days | 3.97 |

A negative Δ Color indicates a relative darkening of the paste over time, which is undesirable. The results of the color analysis indicate that replacing 100% of the diol solvents with an ethoxylated glycerine having an average degree of ethoxylation of 7 provides a substantially more stable color to the paste. Furthermore, even partial replacement of the diol solvents with ethoxylated glycerine improves the color stability (see analysis of samples 2-4 versus sample 1). It is believed that reducing the concentration of propylene glycol in the paste improves the color stability. A positive Δ Color (Sample 6) also indicates improved color stability.

Notably, while the above analysis employs an ethoxylated glycerine with average degree of ethoxylation of 7 and the above-identified anionic surfactant, it is believed that similar results may be achieved using other alkoxylated glycerines and other anionic surfactants.

Detergent Formulation Examples

Example 4 Heavy Duty Liquid Laundry Detergent Compositions

TABLE 20

| | (wt %) | (wt %) | (wt %) | (wt %) | (wt %) | (wt %) |
|---|---|---|---|---|---|---|
| alkoxylated glycerine ($AO_{1-60}$ | 1.5 | 3 | 2 | 8 | 3 | 3 |
| Ethanol | 1.1 | 2 | 1 | 0 | 2 | 2 |
| Diethylene glycol | 0 | 3 | 0 | 0 | 0 | 0 |
| 1,2-Propanediol | 1.7 | 0 | 1 | 0 | 3 | 3 |
| Dipropylene glycol | 0 | 0 | 0 | 0 | 0 | 0 |
| Glycerine | 0 | 0 | 0 | 0.1 | 0 | 0.1 |
| Sodium cumene sulphonate | 0 | 0 | 0 | 2 | 0 | 1 |
| MES | 0 | 0 | 0 | 0 | 4 | 0 |
| AES | 9 | 17 | 3 | 2 | 1 | 15 |
| LAS | 1.5 | 7 | 15 | 6 | 4 | 4 |
| HSAS | 0 | 3 | 0 | 0 | 0 | 0 |
| Isalchem ® 156 | 0 | 0 | 0 | 12 | 0 | 0 |
| AE | 0 | 0.6 | 3 | 4 | 1 | 6 |
| Lauryl Trimethyl Ammonium Chloride | 0 | 1 | 0.5 | 0.25 | 0 | 0 |
| $C_{12-14}$ dimethyl Amine Oxide | 0.3 | 2 | 0.23 | 0 | 0 | 0 |
| Sodium formate | 1.6 | 0.09 | 1.2 | 1.6 | 0 | 0.2 |
| Calcium formate | 0 | 0 | 0 | 0 | 0.13 | 0 |
| Calcium Chloride | 0.01 | 0.08 | 0 | 0 | 0 | 0 |
| Monoethanolamine | 1.4 | 1.0 | 4.0 | 0 | 0 | To pH 8.2 |
| Diethylene glycol | 5.5 | 0.0 | 4.1 | 0.7 | 0 | 0 |
| Chelant | 0.15 | 0.15 | 0.11 | 0.5 | 0.11 | 0.8 |
| Citric Acid | 2.5 | 3.96 | 1.88 | 0.9 | 2.5 | 0.6 |
| $C_{12-18}$ Patty Acid | 0.8 | 3.5 | 0.6 | 1.2 | 0 | 15.0 |
| 4-formyl-phenylboronic acid | 0 | 0 | 0 | 0.1 | 0.02 | 0.01 |
| Borax | 1.43 | 2.1 | 1.1 | 0 | 1.07 | 0 |
| Ethoxylated Polyethylenimine | 0 | 1.4 | 0 | 0 | 0 | 0.8 |
| Zwitterionic ethoxylated quaternized sulfated hexamethylene diamine | 2.1 | 0 | 0.7 | 0.3 | 1.6 | 0 |
| PEG-PVAc Polymer | 0.1 | 0.2 | 0.0 | 0.05 | 0.0 | 1 |
| Grease Cleaning Alkoxylated Polyalkylenimine Polymer | 1 | 2 | 0 | 1.5 | 0 | 0 |
| Fluorescent Brightener | 0.2 | 0.1 | 0.05 | 0.15 | 0.3 | 0.2 |
| Hydrogenated castor oil derivative structurant | 0.1 | 0 | 0.4 | 0 | 0 | 0.1 |
| Perfume | 1.6 | 1.1 | 1.0 | 0.9 | 1.5 | 1.6 |
| Core Shell Melamine-formaldehyde encapsulate of perfume | 0.5 | 0.05 | 0.00 | 0.1 | 0.05 | 0.1 |
| Protease (40.6 mg active/g) | 0.8 | 0.6 | 0.7 | 0.7 | 0.2 | 1.5 |
| Mannanase: Mannaway ® (25 mg active/g) | 0.07 | 0.05 | 0 | 0.04 | 0.045 | 0.1 |
| Amylase: Stainzyme ® (15 mg active/g) | 0.3 | 0 | 0.3 | 0 | 0.6 | 0.1 |
| Amylase: Natalase ® (29 mg active/g) | 0 | 0.6 | 0.1 | 0.07 | 0 | 0.1 |
| Xyloglucanase (Whitezyme ®, 20 mg active/g) | 0.2 | 0.1 | 0 | 0.05 | 0.05 | 0.2 |
| Lipex ® (18 mg active/g) | 0.4 | 0.2 | 0.3 | 0.2 | 0 | 0 |
| *Water, dyes & minors | | | Balance | | | |

*Based on total cleaning and/or treatment composition weight

All enzyme levels are expressed as % enzyme raw material.

Example 5 Unit Dose Compositions—Unit Dose Laundry Detergent Formulations can Comprise One or Multiple Compartments

TABLE 21

| Ingredient | (wt %) | (wt %) | (wt %) | (wt %) | (wt %) |
|---|---|---|---|---|---|
| Ethoxylated glycerine ($PO_{1-10}$) | 4 | 5 | 3 | 4 | 2 |
| 1,2 propanediol | 7 | 13.8 | 13.8 | 13.8 | 13.8 |
| Glycerine | 4 | 0 | 3.1 | 2.1 | 4.1 |
| Di Propylene Glycol | 4 | 0 | 0 | 0 | 0 |
| Sodium cumene sulphonate | 0 | 0 | 0 | 0 | 2.0 |
| AES | 8 | 18 | 9.5 | 12.5 | 10 |
| LAS | 5 | 18 | 9.5 | 14.5 | 7.5 |
| Isalchem ® 156 | 15 | 0 | 5 | 0 | 10 |
| AE | 13 | 3 | 16 | 2 | 13 |
| Citric Acid | 1 | 0.6 | 0.6 | 1.56 | 0.6 |
| $C_{12-18}$ Fatty Acid | 4.5 | 10 | 4.5 | 14.8 | 4.5 |
| Enzymes | 1.0 | 1.7 | 1.7 | 2.0 | 1.7 |
| Ethoxylated Polyethylenimine | 1.4 | 1.4 | 4.0 | 6.0 | 4.0 |
| Chelant | 0.6 | 0.6 | 1.2 | 1.2 | 3.0 |
| PEG-PVAc Polymer | 4 | 2.5 | 4 | 2.5 | 1.5 |
| Fluorescent Brightener | 0.15 | 0.4 | 0.3 | 0.3 | 0.3 |
| Monoethanolamine | 9.8 | 8.0 | 8.0 | 8.0 | 9.8 |
| TIPA | 0 | 0 | 2.0 | 0 | 0 |
| Triethanolamine | 0 | 2.0 | 0 | 0 | 0 |
| Cyclohexyl dimethanol | 0 | 0 | 0 | 2.0 | 0 |
| Water | 12 | 10 | 10 | 10 | 10 |
| Structurant | 0.1 | 0.14 | 0.14 | 0.1 | 0.14 |
| Perfume | 0.2 | 1.9 | 1 | 1.9 | 1.9 |
| Hueing Agent | 0 | 0.1 | 0.001 | 0.0001 | 0 |
| Buffers | | | To pH 8.0 | | |
| Other Solvents (ethanol) | | | To 100% | | |

All enzyme levels are expressed as % enzyme raw material.

Example 6 Unit Dose Compositions—Unit Dose Laundry Detergent Formulations can Comprise One or Multiple Compartments

TABLE 22

| Ingredient | (wt %) | (wt %) | (wt %) | (wt %) | (wt %) |
|---|---|---|---|---|---|
| Propoxylated glycerine ($PO_{1-10}$) | 8 | 10 | 3 | 4 | 3 |
| 1,2 propanediol | 7 | 7 | 13.8 | 13.8 | 11 |
| Glycerine | 4 | 2 | 3.1 | 2.1 | 4 |
| Di Propylene Glycol | 0 | 0 | 0 | 0 | 1 |
| Sodium cumene sulphonate | 0 | 0 | 0 | 0 | 2 |
| AES | 8 | 18 | 9.5 | 12.5 | 10 |
| LAS | 5 | 18 | 9.5 | 14.5 | 7.5 |
| Isalchem ® 156 | 15 | 0 | 5 | 0 | 10 |
| AE | 13 | 3 | 16 | 2 | 13 |
| Citric Acid | 1 | 0.6 | 0.6 | 1.56 | 0.6 |
| $C_{12-18}$ Fatty Acid | 4.5 | 10 | 4.5 | 14.8 | 4.5 |
| Enzymes | 1.0 | 1.7 | 1.7 | 2.0 | 1.7 |
| Ethoxylated Polyethylenimine | 1.4 | 1.4 | 4.0 | 6.0 | 4.0 |
| Chelant | 0.6 | 0.6 | 1.2 | 1.2 | 3.0 |
| PEG-PVAc Polymer | 4 | 2.5 | 4 | 2.5 | 1.5 |
| Fluorescent Brightener | 0.15 | 0.4 | 0.3 | 0.3 | 0.3 |
| Monoethanolamine | 9.8 | 8.0 | 8.0 | 8.0 | 9.8 |
| TIPA | 0 | 0 | 2.0 | 0 | 0 |
| Triethanolamine | 0 | 2.0 | 0 | 0 | 0 |
| Cyclohexyl dimethanol | 0 | 0 | 0 | 2.0 | 0 |
| Water | 12 | 10 | 10 | 10 | 10 |
| Structurant | 0.1 | 0.14 | 0.14 | 0.1 | 0.14 |
| Perfume | 0.2 | 1.9 | 1 | 1.9 | 1.9 |
| Hueing Agent | 0 | 0.1 | 0.001 | 0.0001 | 0 |
| Buffers | | | To pH 8.0 | | |
| Other Solvents (ethanol) | | | To 100% | | |

All enzyme levels are expressed as % enzyme raw material.

Raw Materials for Examples 4-6

LAS is linear alkylbenzenesulfonate having an average aliphatic carbon chain length $C_{11}$-$C_{12}$ supplied by Stepan, Northfield, Ill., USA or Huntsman Corp. HLAS is acid form.

AES is $C_{12-14}$ alkyl ethoxy (3) sulfate, $C_{14-15}$ alkyl ethoxy (2.5) sulfate, or $C_{12-15}$ alkyl ethoxy (1.8) sulfate, supplied by Stepan, Northfield, Ill., USA or Shell Chemicals, Houston, Tex., USA.

AE is selected from $C_{12-13}$ with an average degree of ethoxylation of 6.5, $C_{11-16}$ with an average degree of ethoxylation of 7, $C_{12-14}$ with an average degree of ethoxylation of 7, $C_{14-15}$ with an average degree of ethoxylation of 7, or $C_{12-14}$ with an average degree of ethoxylation of 9, all supplied by Huntsman, Salt Lake City, Utah, USA.

AS is a $C_{12-14}$ sulfate, supplied by Stepan, Northfield, Ill., USA.

HSAS is mid-branched alkyl sulfate as disclosed in U.S. Pat. Nos. 6,020,303 and 6,060,443.

$C_{12-14}$ Dimethylhydroxyethyl ammonium chloride, supplied by Clariant GmbH, Germany.

$C_{12-14}$ dimethyl Amine Oxide is supplied by Procter & Gamble Chemicals, Cincinnati, USA.

Sodium tripolyphosphate is supplied by Rhodia, Paris, France.

Zeolite A is supplied by Industrial Zeolite (UK) Ltd, Grays, Essex, UK.

1.6R Silicate is supplied by Koma, Nestemica, Czech Republic.

Sodium Carbonate is supplied by Solvay, Houston, Tex., USA.

Acrylic Acid/Maleic Acid Copolymer is molecular weight 70,000 and acrylate:maleate ratio 70:30, supplied by BASF, Ludwigshafen, Germany.

PEG-PVAc polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Ethoxylated Polyethylenimine is a 600 g/mol molecular weight polyethylenimine core with 20 ethoxylate groups per —NH. Available from BASF (Ludwigshafen, Germany).

Zwitterionic ethoxylated quaternized sulfated hexamethylene diamine is described in WO 01/05874 and available from BASF (Ludwigshafen, Germany).

Grease Cleaning Alkoxylated Polyalkylenimine Polymer is a 600 g/mol molecular weight polyethylenimine core with 24 ethoxylate groups per —NH and 16 propoxylate groups per —NH. Available from BASF (Ludwigshafen, Germany).

Carboxymethyl cellulose is Finnfix® V supplied by CP Kelco, Arnhem, Netherlands.

Amylases (Natalase®, Stainzyme®, Stainzyme Plus®) may be supplied by Novozymes, Bagsvaerd, Denmark.

Savinase®, Lipex®, Celluclean™, Mannaway®, Pectawash®, and Whitezyme® are all products of Novozymes, Bagsvaerd, Denmark.

Proteases may be supplied by Genencor International, Palo Alto, Calif., USA (e.g. Purafect Prime®) or by Novozymes, Bagsvaerd, Denmark (e.g. Liquanase®, Coronase®).

Suitable Fluorescent Whitening Agents are for example, Tinopal® TAS, Tinopal® AMS, Tinopal® CBS-X, Sulphonated zinc phthalocyanine, available from BASF, Ludwigshafen, Germany.

Chelant is selected from, diethylenetetraamine pentaacetic acid (DTPA) supplied by Dow Chemical, Midland, Mich., USA, hydroxyethane di phosphonate (HEDP) supplied by Solutia, St Louis, Mo., USA; Ethylenediamine-N, N'-disuccinic acid, (S,S) isomer (EDDS) supplied by Octel, Ellesmere Port, UK, Diethylenetriamine penta methylene phosphonic acid (DTPMP) supplied by Thermphos, or 1,2-dihydroxybenzene-3,5-disulfonic acid supplied by Future Fuels Batesville, Ark., USA Hueing agent is Direct Violet 9 or Direct Violet 99, supplied by BASF, Ludwigshafen, Germany.

Soil release agent is Repel-o-tex® PF, supplied by Rhodia, Paris, France.

Suds suppressor agglomerate is supplied by Dow Corning, Midland, Mich., US.

***Suds suppressor derived from phenylpropylmethyl substituted polysiloxanes, as described in the specification.

Acusol 880 is supplied by Dow Chemical, Midland, Mich., USA

TAED is tetraacetylethylenediamine, supplied under the Peractive® brand name by Clariant GmbH, Sulzbach, Germany.

Sodium Percarbonate supplied by Solvay, Houston, Tex., USA.

NOBS is sodium nonanoyloxybenzenesulfonate, supplied by Future Fuels, Batesville, Ark., USA.

"The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. A method of making a concentrated anionic surfactant paste comprising the steps of:

i) mixing from about 30% to about 70% by weight of anionic surfactant, from about 0.5% to about 25% by weight of a solvent comprising an alkoxylated glycerine of formula (I)

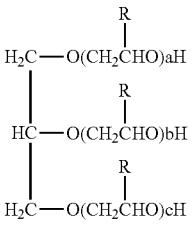

wherein R is $CH_3$ or H, a+b+c has an average value of from about 1 to about 60, and water to form a concentrated anionic surfactant paste, wherein said anionic surfactant paste comprises from about 30% to about 60% by weight of 2-alkyl branched primary alkyl sulfates;

ii) storing and optionally shipping said concentrated anionic surfactant paste, wherein said concentrated anionic surfactant paste is stable during storage.

2. A method of making a detergent composition comprising the steps of:

i) mixing from about 30% to about 70% by weight of anionic surfactant, from about 0.5% to about 25% by weight of a solvent comprising an alkoxylated glycerine of formula (I)

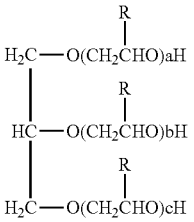

wherein R is $CH_3$ or H, a+b+c has an average value of from about 1 to about 60, and water to form a concentrated anionic surfactant paste, wherein said anionic surfactant paste comprises from about 30% to about 60% by weight of 2-alkyl branched primary alkyl sulfates;

ii) storing and optionally shipping said concentrated anionic surfactant paste, wherein said concentrated anionic surfactant paste is stable during storage;

iii) mixing said stable concentrated anionic surfactant paste with an adjunct and water to form a detergent composition.

3. The method according to claim 1 wherein said concentrated anionic surfactant paste is free of alkoxylated glycerine ester.

4. The method according to claim 2 wherein said detergent composition is free of alkoxylated glycerine ester.

5. The method according to claim 1 wherein said solvent further comprises glycerine, ethanol, propylene glycol, diethylene glycol, dipropylene glycol, or mixtures thereof.

6. The method according to claim 1 wherein said R groups are identical.

7. The method according to claim 1 wherein said anionic surfactant is selected from the group consisting of linear or branched alkyl benzene sulfonates, linear or branched alkoxylated alkyl sulfates, linear or branched alkyl sulfates, and mixtures thereof.

8. The method according to claim 1 wherein said concentrated anionic surfactant paste comprises from about 30% to about 60% by weight of linear or branched alkyl sulfates, linear or branched alkyl benzene sulfonates, or mixtures thereof.

9. The method according to claim 2 wherein said adjunct is selected from the group consisting of a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof.

10. The method according to claim 2 wherein said adjunct comprises an enzyme selected from the group consisting of lipase, amylase, protease, mannanase, cellulase, pectinase, and mixtures thereof.

11. The method according to claim 2 wherein said adjunct comprises from about 0.001% to about 1% by weight of enzyme.

12. The method according to claim 2, wherein said detergent composition is a form selected from the group consisting of a liquid laundry detergent, a gel detergent, a single-phase or multi-phase unit dose detergent, a detergent contained in a single-phase or multi-phase or multi-compartment water-soluble pouch, a liquid hand dishwashing composition, a laundry pretreat product, a fabric softener composition, and mixtures thereof.

13. The method according to claim 2, wherein said detergent composition comprises less than about 20%, by weight of the composition, water.

14. The method according to claim 2, wherein said detergent composition is a detergent contained in a single-phase or multi-phase or multi-compartment water-soluble pouch.

* * * * *